United States Patent [19]

Naastepad et al.

[11] 4,060,692

[45] Nov. 29, 1977

[54] INDUCTION MELTING FURNACE

[75] Inventors: Pieter Aart Naastepad; Jacob Willem de Ruiter, both of Eindhoven, Netherlands

[73] Assignee: U.S. Philips Corporation, New York, N.Y.

[21] Appl. No.: 695,773

[22] Filed: June 14, 1976

[30] Foreign Application Priority Data

June 20, 1975 Netherlands ..... 7507358

[51] Int. Cl.[2] ..... H05B 5/00; F27D 11/06

[52] U.S. Cl. ..... 13/26; 13/27

[58] Field of Search ..... 13/26, 27, 35

[56] References Cited

U.S. PATENT DOCUMENTS

| | | | |
|---|---|---|---|
| 2,755,326 | 7/1956 | Kennedy | 13/27 |
| 3,401,227 | 9/1968 | Dunlevy et al. | 13/26 X |
| 3,944,715 | 3/1976 | Hegewaldt et al. | 13/27 |

*Primary Examiner*—R. N. Envall, Jr.
*Attorney, Agent, or Firm*—Frank R. Trifari; Bernard Franzblau

[57] ABSTRACT

An induction melting furnace comprising a conical crucible and a conical induction coil which envelops the crucible. The induction furnace comprises means for bringing the crucible under a compression stress and for maintaining this compression stress during the melting process.

13 Claims, 1 Drawing Figure

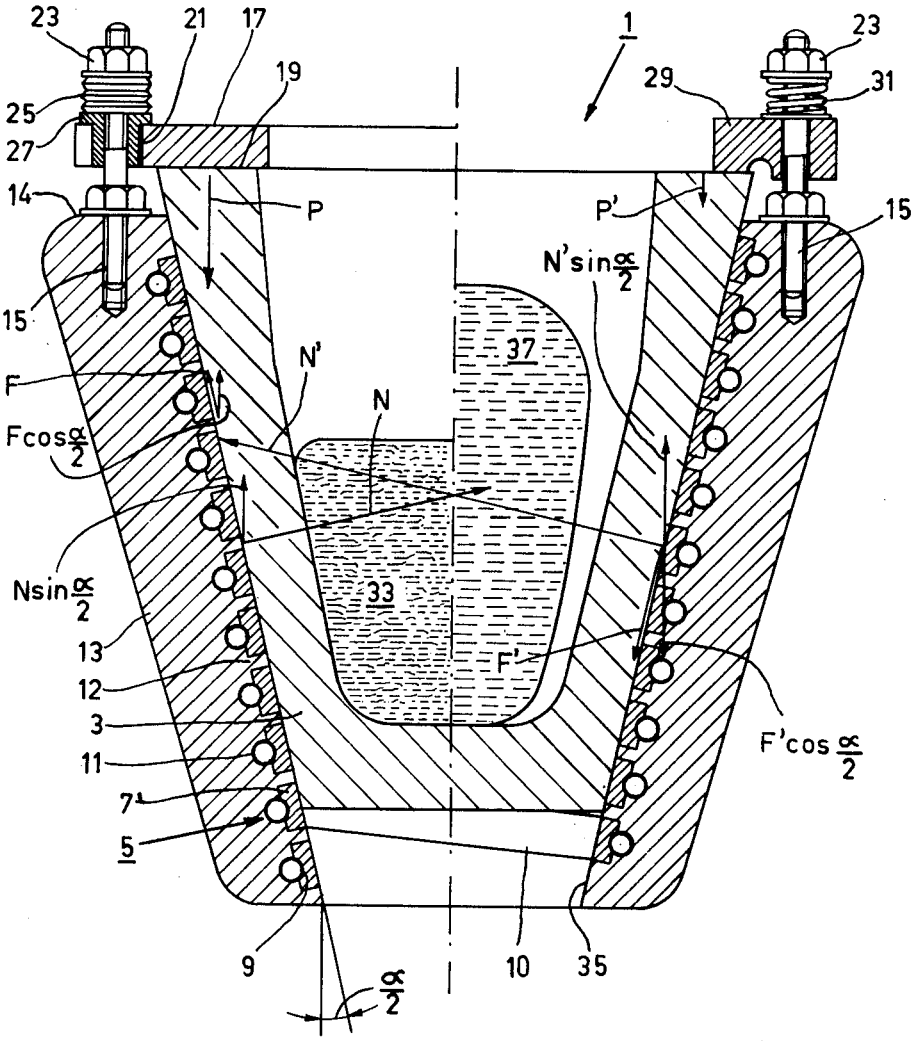
23
21
17
19
1
23
29
31
25
27
14
P
P'
15
N'sin α/2
15
37
N'
F
N
Fcos α/2
Nsin α/2
33
13
F'
12
3
F'cos α/2
11
7
5
9
10
35
α/2

INDUCTION MELTING FURNACE

The invention relates to an induction melting furnace comprising a water-cooled induction coil and a supporting body having a conical inner circumference for supporting a conical crucible.

Induction melting furnaces are used in particular for melting metals and alloys at a laboratory scale in quantities of from 0.1 $dm^3$ to approximately 2 $dm^3$. It is very important that reactions between the crucible lining and the charge remain within permissible limits. Densely sintered $Al_2O_3$ is very suitable for most metals and alloys in this respect but has the drawback of a low thermal shock resistance which leads to cracking. The cracks may be so severe that the molten charge escapes.

Induction melting furnaces are known which comprise crucibles having crack-restoring properties. For example, as disclosed in German Pat. No. 854,240, a packing mass is rammed into the induction melting furnace to be heated by the charge itself, and a crucible wall is then produced by the sintering of the inner layer of said mass. After prolonged use a crucible wall of adequate thickness will be maintained, even after erosion, because the said sintering process continues during use. Crucibles of this kind cannot be interchanged and are not suitable for sizes having an effective volume of up to approximately 2 $dm^3$ because the ratio between the inner diameter of the crucible and the diameter of the induction coil is unfavorable, considering the large quantity of packing mass between the inner wall of the crucible and the induction coil, thus resulting in a poor melting yield. This crucible construction is particularly disadvantageous for vacuum melting because the evacuation of the large quantity of packing mass is very time-consuming. The manufacture and the use of such crucibles is labor-intensive and also expensive because a separate induction coil is required for each crucible since the crucible cannot be interchanged.

It is also known to use prefabricated crucibles, densely sintered or not, which are supported along the outer circumference by filling the space between crucible and induction coil with a bulk mass, for example, dry rammed sand, cardboard, ceramic material and the like. This prefabricated crucible construction is exchangeable and less labor-intensive, but less reliable because the risk of cracking and leakage is greater. Moreover, in view of the gas-releasing support, this crucible construction also involves longer evacuation times.

The crucible of the induction melting furnace described in the said German Pat. No. 854,240 has a conical construction with an apex angle such that the crucible can shift with respect to the induction coil under the influence of the expansion occurring during melting, so that damage to the induction coil is prevented. However, the increasing compression stresses on the crucible occurring during the melting process are thus eliminated, which results in an increasing cracking tendency.

The invention has for an object to provide an induction melting furnace which is particularly suitable for vacuum melting and in which the cracking of the crucible, disturbing the melting process, tends not to occur, not even in the case of very quick heating of the charge.

In accordance with the invention tensioning means are provided for subjecting a prefabricated crucible to an axial load during mounting, thus bringing it under a radial compression stress, and for maintaining this radial compression stress during the operation of the induction melting furnace.

Once the crucible has been brought under compression stress during mounting, this compression stress will be maintained or even increased during the melting process because a relative shift of crucible and support during the melting process is prevented or at least limited. This is contrary to the furnace construction disclosed in the German Pat. No. 845,240. The maintenance or increase of the compression stress is dependent on the difference in expansion between crucible and supporting body. Because the crucible is brought and maintained under radial compression stress, the disturbing cracking tends not to occur because any cracks occurring remain closed thanks to the radial compression stress. The crucible has a long service life, even at high heating rates, is exchangeable and is suitable for frequent use.

Suitably, the apex angle of the inner circumference of the supporting body is such that the tangent of half the apex angle is smaller than the friction coefficient between crucible and supporting body.

It is thus achieved that, after the crucible has been secured in the supporting body and brought under radial compression stress by means of the tensioning means during mounting, the frictional force between crucible and supporting body is larger than the axial component of the force which acts on the crucible due to expansion during operation and which tends to expel the crucible from the supporting body. This step produces a self-clamping effect, that is to say that as the expansion increases, the radial compression stress increases without additional external forces being involved. However, this imposes an additional condition: no permanent shape modifications of the supporting body may occur.

Suitably also, when the tangent of half the apex angle of the inner circumference of the supporting body is larger than the friction coefficient between crucible and supporting body, the tensioning means comprise pretensioning members and holding members which cooperate with the head face of the crucible. The crucible is brought under a desired compression stress during mounting by means of the pretensioning members. Subsequently, the holding members are fitted, after which the pretensioning members may be removed. During the melting process the compression stress can be adjusted to a permissible limit by means of these holding members. This step precludes permanent deformation of the supporting body.

The induction coil may be of conical construction and at the same time may act as the supporting body. A suitable inductive coupling with the charge then is obtained, which is contrary to the known induction melting furnace. Furthermore, when this step is taken, a separate, gas releasing supporting body can be dispensed with. Thanks to the conical shape of the induction coil, moreover, a levitation effect is obtained on the charge, that is to say that in the case of high power settings the charge disengages from the crucible wall. As a result, the heat given off to the crucible wall by the charge is limited, resulting in lower crucible temperatures, the more so because proper heat transfer from crucible to coil exists in that the induction coil is in direct contact with the outer circumference of the crucible. The aforesaid factors contribute to the inhibition of undesired reactions between charge and crucible material, which means that wear of the crucible wall and contamination of the charge are minimized. This also offers more freedom in the choice of ceramic material for the crucible.

Considering the favorable thermal contact between the crucible and the water-cooled coil, a comparatively quick cooling of the molten charge is also feasible. This may be advantageous in the case of intentional intermediate interruption of the melting process. When the charge is molten again, damage to the crucible due to expansion of the charge is prevented thanks to the conical inner circumference of the crucible as opposed to a cylindrical crucible.

As a result of the levitation effect, the molten charge disengages, as has already been stated, from the crucible wall, which is accompanied by a very intense bath mixing. Both factors, i.e., the levitation effect and bath mixing, are extremely favorable for the de-gassing of the molten charge.

In the case of vacuum melting it is difficult in practice to achieve on oxide-free melting bath because no means are known for removing the oxide particles present on the bath surface. A furnace construction embodying the invention enables the removal of these particles from the molten charge, because it has been found that the said oxide particles adhere to the crucible wall. When the crucible material is suitably chosen, particularly when less refractory material is used, which is possible in view of the greater freedom in the choice of the material, the oxide particles are left behind in the crucible when the charge is poured out.

The induction coil may consist of a helically wound, hollow current conductor which has a wall thickness of at least 5 mm over the portion thereof which contacts the crucible, the space between the turns being filled with an electrically non-conductive material. Thanks to the wall portion of at least 5 mm thickness, a safe shielding between water cooling and any escaped charge is obtained. The filling of the space between the turns offers a reliable insulation of the induction coil, thus preventing voltage breakdown and arc discharges. Moreover, mechanical vibrations produced by the induction currents in the coil are suppressed and any disturbing noise is prevented.

The induction coil may be supported on the outer circumference by a reinforcement jacket. The reinforcement jacket can be constructed either as a separate element or integral with the induction coil.

The reinforcement jacket may be constructed as an electrically interrupted, water-cooled metal jacket. The metal jacket can then also serve to close the diagram of forces and to ensure that the electrically non-conductive material of the induction coil is not thermally damaged.

The reinforcement jacket may consist of reinforced synthetic resin so that, in a simple manner, a construction is obtained which is capable of taking up the stresses without permanent deformation of the induction melting furnace occurring.

Suitably, the conical inner circumference of the induction coil has an apex angle of at least 24°. Experiments have revealed that the desired result, that is to say a self-clamping effect between crucible and induction coil, or only small holding forces being required, is obtained when such an angle is used, while the crucible can still be removed without being damaged or destroyed.

An embodiment of the invention will now be described by way of example with reference to the diagrammatic drawing which is a diagrammatic longitudinal sectional view of an induction melting furnace embodying the invention, the left half illustrating the situation during the mounting of the crucible, while the right half illustrates the situation during operation of the induction melting furnace.

The induction melting furnace 1 comprises a conical crucible 3 and a conical induction coil 5 which serves as the support body for supporting the crucible.

The crucible 3 is prefabricated and consists of a ceramic material which is compatible with the alloy to be melted. The induction coil 5 consists of a helical current conductor composed of a copper strip 7 which is provided on its outer circumference with a shallow groove 9 in which a copper cooling pipe 11 has been secured by soldering. The total thickness of strip and cooling pipe amounts to at least 5 mm over the portion adjoining the crucible. The cooling pipe can be connected to an inlet and an outlet for cooling water via connections, not shown. The induction coil can be connected in the usual manner to a generator. On the outer circumference of the induction coil 5 there is provided a reinforcement jacket 13 of reinforced synthetic resin which also fills the space 12 between the turns 10 of the strip 7 and of the cooling pipe 11 and which is integral with the induction coil 5 in the embodiment shown.

The furnace comprises tensioning means for subjecting the prefabricated crucible to an axial load during mounting and thus bring it under a radial compression stress and for maintaining this radial compression stress during the operation of the induction melting furnace. To this end, a plurality of bolts 15, regularly distributed along the circumference, are secured in the head face 14 of the jacket 13. The left half of the drawing shows pretensioning means comprising a pressure ring 17 and spring washers 25. The pressure ring 17 bears on the head face 19 of the crucible 3 and has recesses 21 through which the bolts 15 project. The spring washers 25 are tensioned by nuts 23 and act on the pressure ring 17 via bushings 27. The right half of the drawing shows holding members consisting of clamping members 29 which are pressed against the head face 19 of the crucible 3 by means of the nuts 23 and by helical springs 31.

In order to melt a charge 33, the crucible is pressed into the induction coil 5, by means of the cupped spring washers 25 and the pressure ring 17, with a force P and is thus subjected to a given axial load and brought under a radial compression stress across the entire circumference. Taking into account the conical shape of the crucible 3 and of the induction coil 5, and also taking into account the friction coefficient $f$ between crucible and induction coil, in this particular embodiment the force $P \geqq F \cos(\alpha/2) + N \sin(\alpha/2)$, in which $F = f \cdot N$ and in which $\alpha/2$ denotes half the apex angle of the outer circumference of the crucible and of the inner circumference 35 of the induction coil, while $N$ denotes the normal force acting on the crucible, $F$ being the frictional force and $f$ the friction coefficient between crucible and induction coil.

During the melting process, the crucible thus pretensioned could, if desired, be maintained under compression stress by means of the cupped spring washers 25 and the pressure ring 17.

However, because the crucible will expand more during the melting process than the cooled induction coil, the forces acting on the crucible thus increasing, a much smaller holding force $P'$ will suffice during the melting process. Therefore, once the crucible has been secured and prior to the start of melting, the cupped spring washers 25 and the pressure ring 17 suitably are replaced by the helical springs 31 and the clamping members 29 which exert the holding force $P'$ on the crucible. The forces occurring during the melting process are shown in the right half of the drawing, and can be expressed as $$P' \geqq N' \sin(\alpha/2) - F \cos(\alpha/2) \text{ and } N' > N,$$

where the frictional force $F' = f \cdot N'$,
and hence $F' > F$
and is opposed to $F$.

By a suitable choice of the apex angle of the crucible and of the induction coil in dependence on the friction coefficient $f$, where $\tan(\alpha/2) \geqq f$, the holding force $P'$ can be limited to a value such that the maximum value of $N'$ then occurring cannot cause permanent deformation of the furnace construction. This is achieved in that the helical springs 31 permit a relative displacement of crucible and induction coil, if required.

In given circumstances it can be achieved, by a suitable combination of the construction materials to be used, that on the one hand the compression stress is maintained at the required minimum value or is even increased, solely due to the frictional forces, while on the other hand permanent deformation of the furnace construction is prevented. In this case the apex angle must have a value such that $F' \cos(\alpha/2) \geqq N' \sin(\alpha/2)$, where $F' = f \cdot N'$, so that $f \geqq \tan(\alpha/2)$.

In a practical embodiment, the induction coil and the prefabricated crucible, made of refractory concrete, had an apex angle $\alpha$ of 24°, and the friction coefficient $f$ between crucible and induction coil amounted to 0.24; $\tan(\alpha/2)$ was equal to 0.21255, and so was smaller than $f$.

The right half of the drawing shows the molten charge 37 which disengages from the crucible wall due to the levitation effect obtained thanks to the conical induction coil.

After the pouring of the molten charge 37 and after the cooling of the crucible, the latter can be replaced, if so desired, in a quick and simple manner by an other crucible for melting another type of alloy.

What is claimed is:

1. An induction melting furnace comprising a prefabricated conical crucible, a water-cooled induction coil and a supporting body having a conical inner circumference for supporting said conical crucible, and tensioning means arranged to subject the prefabricated crucible to an axial load during mounting to bring it under a radial compression stress and for maintaining said radial compression stress during the operation of the furnace.

2. A furnace as claimed in claim 1, characterized in that the apex angle of the inner circumference of the supporting body has a value such that the tangent of half the apex angle is smaller than the friction coefficient between the crucible and supporting body.

3. A furnace as claimed in claim 1, in which the tangent of half the apex angle of the inner circumference of the supporting body is larger than the friction coefficient between crucible and supporting body, characterized in that the tensioning means comprise pretensioning members and holding members which cooperate with the head face of the crucible.

4. A furnace as claimed in claim 1 wherein the induction coil has a conical construction and simultaneously acts as the supporting body.

5. A furnace as claimed in claim 4, characterized in that the induction coil comprises a helically wound, hollow current conductor which has a wall thickness of at least 5 mm over the portion thereof which is in contact with the crucible, the space between the turns being filled with an electrically non-conductive material.

6. A furnace as claimed in claim 4, characterized in that the induction coil is supported on the outer circumference by a reinforcement jacket.

7. A furnace as claimed in claim 6, characterized in that the reinforcement jacket is constructed as an electrically interrupted, water-cooled metal jacket.

8. A furnace as claimed in claim 6, characterized in that the reinforcement jacket comprises a reinforced synthetic resin.

9. A furnace as claimed in claim 1 wherein the coil has a conical shape and the conical inner circumference of the induction coil has an apex angle of at least 24°.

10. A furnace as claimed in claim 4 wherein the conical inner circumference of the induction coil has an apex angle of at least 24°.

11. An induction type melting furnace comprising a conical shaped water-cooled induction coil and a support body having a conical inner surface, a conical shaped crucible supported within said support body and induction coil, and means for applying an axial force to said crucible so as to bring it under a radial compression stress and for maintaining said stress during furnace operation, the apex angle of the inner surface of the support body being related to the coefficient of friction between the crucible and support body so as to provide a self-clamping effect between the crucible and support body during furnace operation.

12. A furnace as claimed in claim 11 wherein said force applying means comprises a ring member in contact with the head face of the crucible and means for pressing said ring member against said crucible head face.

13. A furnace as claimed in claim 11 wherein said apex angle is at least 24°.

* * * * *